US007905390B1

(12) United States Patent
Settle et al.

(10) Patent No.: US 7,905,390 B1
(45) Date of Patent: Mar. 15, 2011

(54) MAILBOX ALERT DEVICE

(76) Inventors: Amy D. Settle, Jerseyville, IL (US); Patrick A. Compton, Jerseyville, IL (US)

( * ) Notice: Subject to any disclaimer, the term of this patent is extended or adjusted under 35 U.S.C. 154(b) by 0 days.

(21) Appl. No.: 12/717,010

(22) Filed: Mar. 3, 2010

(51) Int. Cl.
*A47G 29/14* (2006.01)

(52) U.S. Cl. ..... 232/35

(58) Field of Classification Search ..... 232/35, 232/34, 17, 45; D99/29–32; 109/43; 116/173–175, 116/215, 307
See application file for complete search history.

(56) References Cited

U.S. PATENT DOCUMENTS

| | | | | | |
|---|---|---|---|---|---|
| 1,248,171 | A | * | 11/1917 | Schubert | 232/35 |
| 2,507,623 | A | * | 5/1950 | Diaz | 116/174 |
| 2,630,779 | A | * | 3/1953 | Mader | 116/173 |
| D183,625 | S | | 9/1958 | Masso | |
| 3,904,108 | A | * | 9/1975 | File | 232/35 |
| 3,958,752 | A | * | 5/1976 | Pieszchala | 232/35 |
| 3,976,283 | A | | 8/1976 | Schmit | |
| 4,073,430 | A | * | 2/1978 | Joris | 232/35 |
| 4,138,056 | A | * | 2/1979 | Sherrill | 232/35 |
| 4,205,778 | A | * | 6/1980 | File | 232/35 |
| 4,262,839 | A | | 4/1981 | Wisniewski | |
| 4,596,357 | A | * | 6/1986 | File | 232/35 |
| 4,711,391 | A | * | 12/1987 | Roge et al. | 232/35 |
| 4,728,028 | A | * | 3/1988 | Barnes et al. | 232/35 |
| 4,753,386 | A | | 6/1988 | Phillion, Sr. | |
| D350,298 | S | | 9/1994 | Horton | |
| 5,454,202 | A | * | 10/1995 | van der Weijden | 40/606.09 |
| 6,057,787 | A | | 5/2000 | Kell et al. | |
| 6,575,357 | B1 | | 6/2003 | Rundell | |
| D478,702 | S | | 8/2003 | Dregney | |
| 7,530,325 | B2 | * | 5/2009 | Swenson et al. | 116/173 |

OTHER PUBLICATIONS www.wdrake.com; Mail Time; as of Nov. 19, 2007.

* cited by examiner

*Primary Examiner* — William L. Miller

(57) ABSTRACT

A mailbox alert device comprising a flag pole attached to the mailbox; a first pulley disposed near the first end of the flag pole and a second pulley disposed the second end of the flag pole; a circular cable wrapped around the pulleys; a flag attached to the front portion of the cable; a flag stopper attached to the front portion of the cable at the top of the flag; wherein the flag can be moved between an up position and a down position, wherein the flag is biased in the up position caused by a weight attached to the back portion of the cable; tab dispose don the flag for closing in the door of the mailbox, which secures the flag in the down position until the door is opened to deliver mail.

3 Claims, 4 Drawing Sheets

MAILBOX ALERT DEVICE

FIELD OF THE INVENTION

The present invention is directed to a mailbox device for alerting a resident that he/she has received mail, more particularly to a device that raises a flag when mail is delivered.

BACKGROUND OF THE INVENTION

It can be very helpful to alert residents when their mail is delivered to their homes. The present invention features a mailbox alert device for indicating that mail has been delivered to the mailbox via a flag-raising mechanism.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
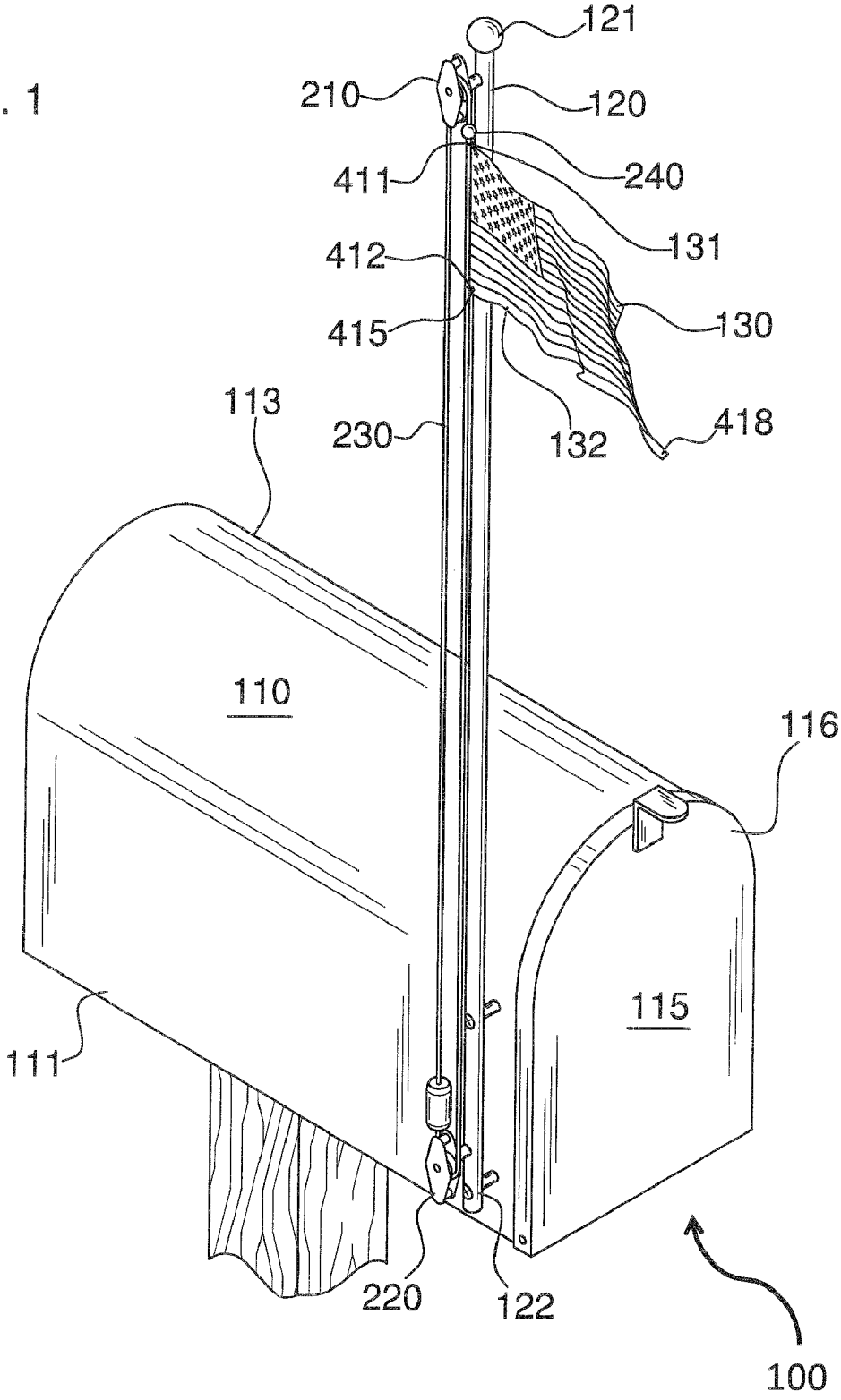
FIG. 1 is a perspective view of the mailbox alert device of the present invention.
Figure 2:
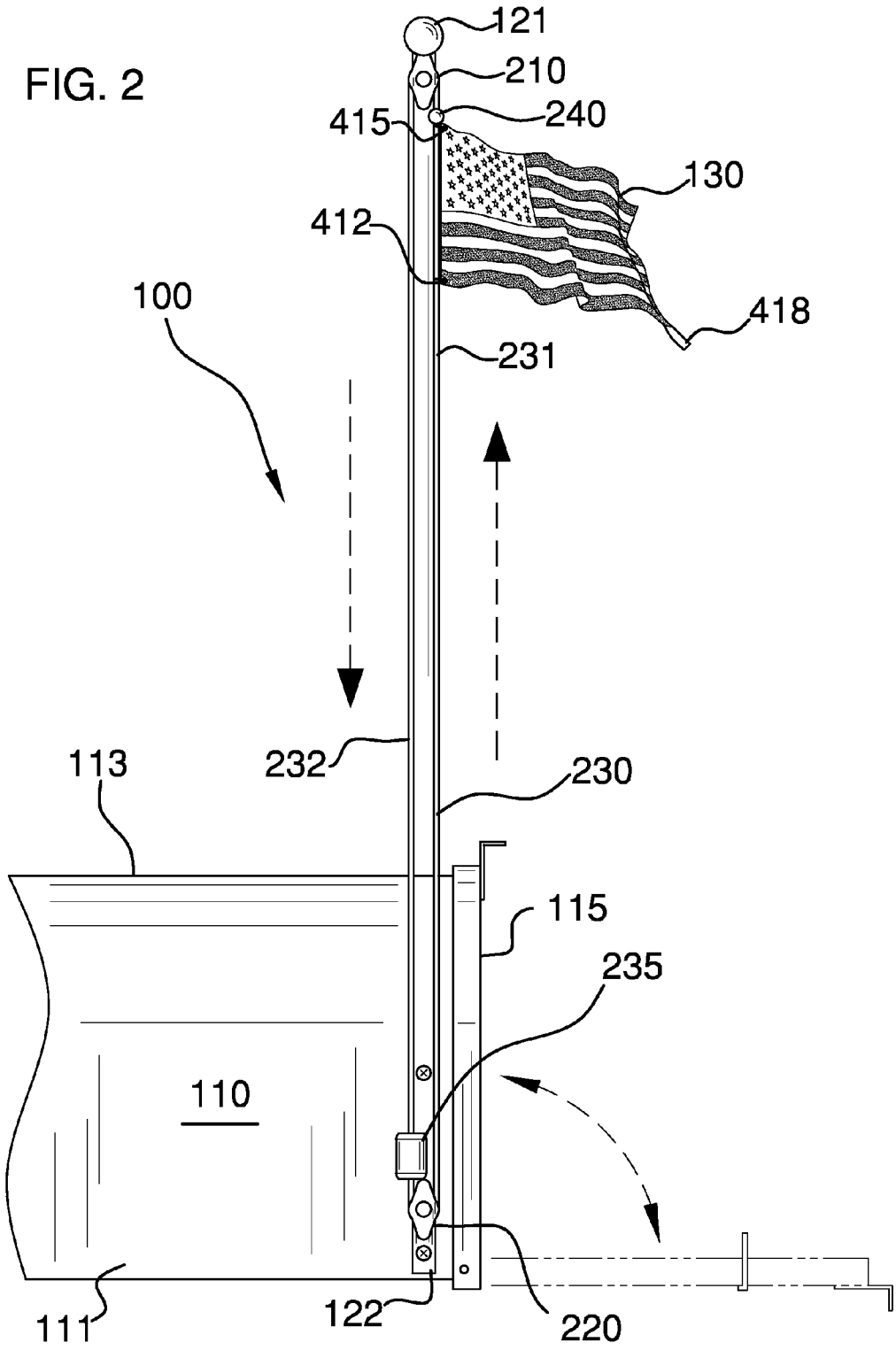
FIG. 2 is a side view of the mailbox alert device of the present invention.
Figure 3:
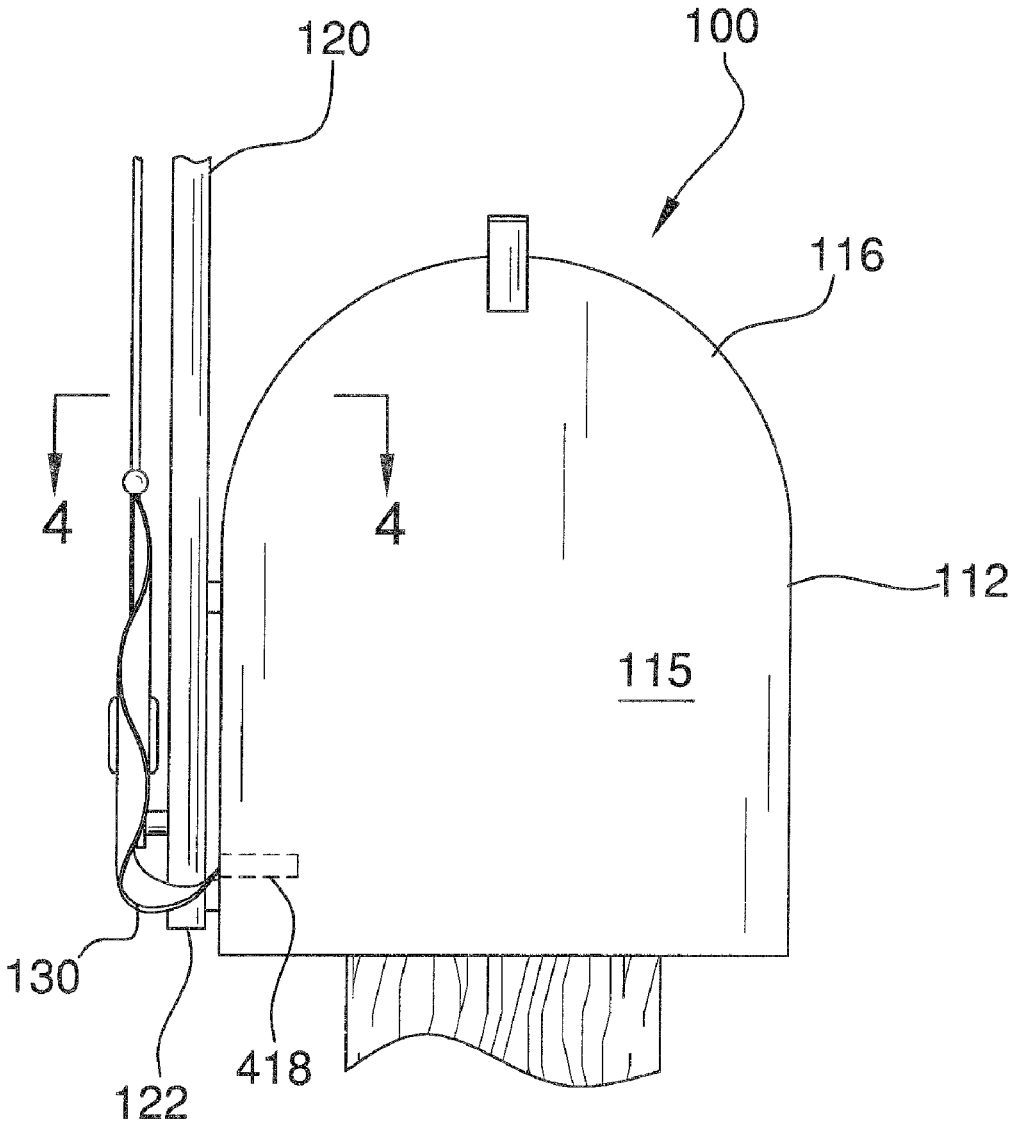
FIG. 3 is a front view of the mailbox alert device of the present invention.
Figure 4:
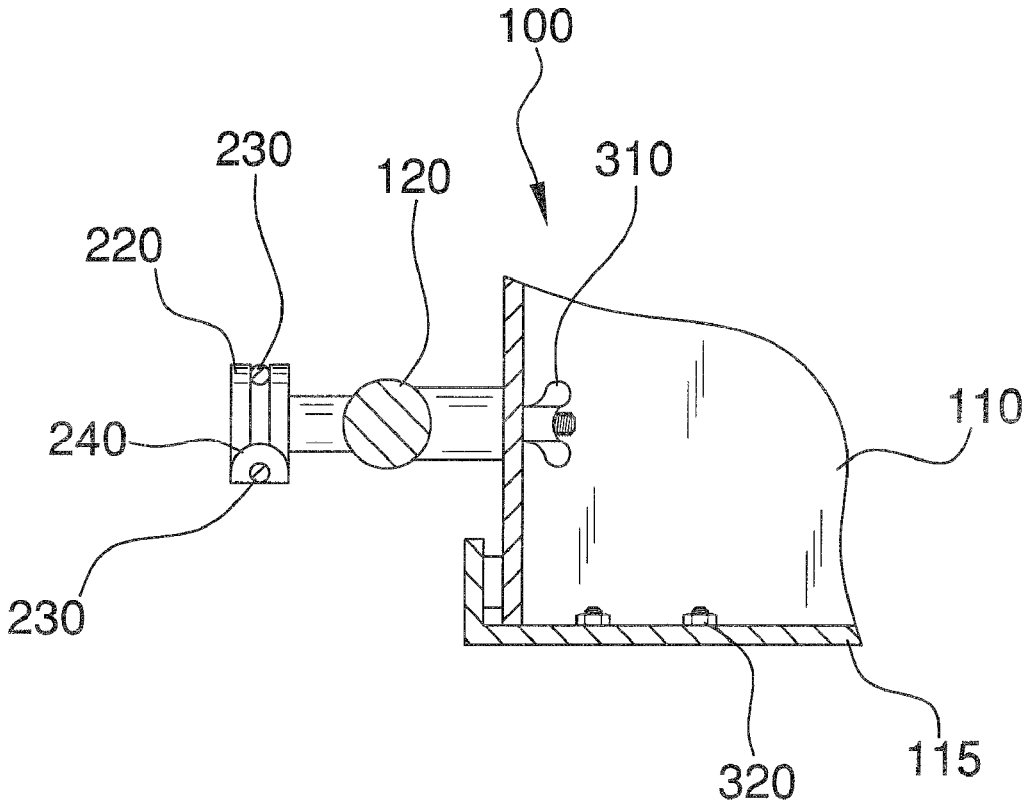
FIG. 4 is a top cross sectional view of the mailbox alert device of the present invention.

Referring now to FIGS. 1-4, the present invention features a mailbox alert device 100 for alerting a resident that mail has arrived in his/her mailbox. The mailbox alert device 100 is for mounting on a mailbox 110, for example a standard mailbox 110 having a first side 111, a second side 112, a top 113, and a front door 115 with an outer surface 116.

The mailbox alert device 100 comprises a flag pole 120 having a first end 121 and a second end 122. The flag pole 120 (e.g., second end 122 of flag pole 120) is attached to the first side 111 or second side 112 of the mailbox 110 with the first end 121 oriented above the mailbox 110 (e.g., the flag pole 110 is oriented generally vertically). In some embodiments, the second end 122 of the flag pole 120 is attached to the first side 111 of the mailbox 110 via a first attachment means 310 (e.g., nails, bolts, screws, etc). The flag pole 120 is mounted on the mailbox 110 at or near the front door 115 (see FIG. 1).

Attached to the flag pole 120 near the first end 121 is a first pulley 210, and attached to the flag pole 120 near the second end 122 is a second pulley 220. A cable 230 is wrapped around the first pulley 210 and second pulley 230. Cables and pulleys are well known to one of ordinary skill in the art. The cable 230 is oriented on the first pulley 210 and second pulley 220 such that it has a front portion 231 and a back portion 232. In some embodiments, the front portion 231 of the cable 230 faces in the direction of the front door 115 of the mailbox 110.

Attached to one position (e.g., a first position) on the cable 230 on the back portion 232 is a weight 235. Attached to one position (e.g., a first position) on the cable 230 on the front portion 231 is a flag 130, wherein the flag 130 has a top edge 131 and a bottom edge 132 (see FIG. 2). The flag 130 may be of various sizes, colors, and designs. Attached to the cable 230 at the top edge 131 of the flag 130 is a flag stopper 240. A tag 418 is disposed on a side edge of the flag 130. The flat 130 is configured such that the tag 418 can be temporarily closed into the door 115 of the mailbox 110 so as to hold the flat 130 in place (in a down position), and also to help prevent the flag 130 from flapping about during windy conditions.

In some embodiments, the flag 130 is removably attached to the cable 230. The flag 130 can be removed and replaced with a differently designed flag 130. In some embodiments, the flag 130 comprises one or more grommets 415, which can allow the flag 130 to be clipped onto to the cable 230, for example via a first clip 411 and/or a second clip 412.

The cable 230 can move about the first pulley 210 and second pulley 220 such that the flag 130 can move between an up position and a down position. In the up position, the flag 130 is near the first end 121 of the flag pole 120 (see FIG. 1, FIG. 2). In the down position, the flag 130 is near the second end 122 of the flag pole 120 (see FIG. 3). The flag 130 is biased in the up position caused by the weight 235 attached to the cable 230 on the back portion 232. The tab 418 of the flat 130 is secured in the front door 115, holding the cable 230 in the down position.

When the front door 115 is opened (e.g., by a mailman/mailwoman), the tab 418 is released from the front door 115. This allows the weight 235 to be released downward toward the second end 122 of the flag pole 120 and in turn the flag 130 is raised to the up position. When the flag 130 is in the up position, a resident would be alerted that mail has been delivered to his/her mailbox 110.

The mailbox alert device 100 may be constructed in a variety of sizes. For example, in some embodiments, the flag pole 120 is between about 12 to 18 inches in height as measured from the first end 121 to the second end 122. In some embodiments, the flag pole 120 is between about 18 to 24 inches in height as measured from the first end 121 to the second end 122. In some embodiments, the flag pole 120 is more than about 24 inches in height.

As used herein, the term "about" refers to plus or minus 10% of the referenced number. For example, an embodiment wherein the flag pole 120 is about 20 inches in height includes a flag pole 120 that is between 18 and 22 inches in height.

In an alternative embodiment, a flag release component is disposed on the front door 115 of the mailbox 110. The flag release component is disposed on the side of the door 115 corresponding to the side of the mailbox 110 that the flag pole 120 is disposed. In some embodiments, the flag release component is attached to the door 115 via a second attachment means.

The flag release component may be generally L-shaped having a first half connected to a second half, e.g., at about a 90 degree angle. The first half of the flag release component is for attaching to the door 115 of the mailbox 110. The second half of the flag release component is for engaging the cable 230. For example, in some embodiments, a groove is disposed in the second half of the flag release component, wherein the cable 230 is slidably inserted into the groove. The flag 130 can be secured in the down position by placing the flag stopper 240 underneath the flag release component. This prevents the weight 235 from pulling the flag 130 upwardly to the up position.

When the front door 115 is opened (e.g., by a mailman/mailwoman), the flag release component (e.g., groove) is pulled away from the flag stopper 240 on the cable 230. This allows the weight 235 to be released downward toward the second end 122 of the flag pole 120 and in turn the flag 130 is raised to the up position. When the flag 130 is in the up position, a resident would be alerted that mail has been delivered to his/her mailbox 110.

The present invention also features methods of alerting an individual that mail has arrived in a mailbox. For example, in some embodiments, the method comprises obtaining a mailbox alert device of the present invention and attaching the second end of the flag pole to a first side of the mailbox near a front door via a first attachment means (and positioning the first end of the flag pole above the mailbox). The method may further comprise moving the flag to the down position and closing the tab of the flag in the front door to prevent the weight from pulling the flag upwardly to the up position. The method may further comprise opening the front door to insert mail into the mailbox, whereby opening the front door releases the tab from the front door, which allows the weight to fall toward the second end of the flag pole and the flag to move to the up position, when the flag is in the up position it is indicative that mail has arrived in the mailbox.

The following the disclosures of the following U.S. Patents are incorporated in their entirety by reference herein: U.S. Pat. No. 6,057,787; U.S. Pat. No. 3,976,283; U.S. Pat. No. 4,753,386; U.S. Pat. No. 4,262,839; U.S. Pat. No. 6,575,357.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mailbox alert device for alerting a resident that mail has arrived in a mailbox, said mailbox alert device comprising:

(a) a vertically oriented flag pole having a first end extending above the mailbox and a second end attached to a first side of the mailbox via a first attachment means;

(b) a first pulley disposed near the first end of the flag pole and a second pulley disposed near the second end of the flag pole;

(c) a circular cable adapted to wrap and slide around both the first pulley and the second pulley, wherein the cable has a front portion and a back portion;

(d) a flag attached to a first position on the front portion of the cable;

(e) a tab disposed on a side edge of the flag; and (f) a flag stopper attached to the front portion of the cable at a top edge of the flag; wherein the flag is movable between an up position near the first end of the flag pole and a down position near the second end of the flag pole, wherein the flag is biased in the up position caused by a weight attached to a first position on the back portion of the cable;

wherein the flag is secured in the down position by closing the tab of the flag in the front door, which prevents the weight from pulling the flag upwardly to the up position; wherein when the from door of the mailbox is opened, the tab is released from the door, which allows the weight to fall toward the second end of the flag pole and the flag to move to the up position.

2. The mailbox alert device of claim 1, wherein the flag is removably attached to the cable via a first clip and a second clip.

3. A method of alerting an individual that mail has arrived in a mailbox, said method comprising:

(a) obtaining a mailbox alert device comprising:

(i) a vertically oriented flag pole having a first end and a second end;

(ii) a first pulley disposed near the first end of the flag pole and a second pulley disposed the second end of the flag pole;

(iii) a circular cable adapted to wrap and slide around both the first pulley and the second pulley, wherein the cable has a front portion and a back portion;

(iv) a flag attached to a first position on the front portion of the cable;

(v) a tab disposed on a side edge of the flag; and (vi) a flag stopper attached to the front portion of the cable at a top edge of the flag, wherein the flag is movable between an up position near the first end of the flag pole and a down position near the second end of the flag pole, wherein the flag is biased in the up position caused by a weight attached to a first position on the back portion of the cable;

(b) attaching the second end of the flag pole to a first side of the mailbox near a front door via a first attachment means and positioning the first end of the flag pole above the mailbox;

(c) moving the flag to the down position and closing the tab of the flag in the front door to prevent the weight from pulling the flag upwardly to the up position;

(d) opening the front door to insert mail into the mailbox, whereby opening the front door releases the tab from the front door, which allows the weight to fall toward the second end of the flag pole and the flag to move to the up position, when the flag is in the up position it is indicative that mail has arrived in the mailbox.

* * * * *